US006182981B1

(12) United States Patent
Kuo

(10) Patent No.: US 6,182,981 B1
(45) Date of Patent: Feb. 6, 2001

(54) TWO-STAGE EXPANSION/COLLAPSE CONTROL MECHANISM FOR USE ON A HAND-TRAILABLE LUGGAGE CASE

(75) Inventor: Chung-Hsien Kuo, Taipei (TW)

(73) Assignee: Chaw Khong Technology Co., Ltd., Taipei County (TW)

( * ) Notice: Under 35 U.S.C. 154(b), the term of this patent shall be extended for 0 days.

(21) Appl. No.: 09/236,324

(22) Filed: Jan. 25, 1999

(30) Foreign Application Priority Data

Jul. 2, 1998 (TW) ..... 87210633

(51) Int. Cl.[7] ..... B62B 7/06

(52) U.S. Cl. ..... 280/37; 280/47.17; 280/47.26; 280/47.371; 280/79.2; 190/18 A; 190/34

(58) Field of Search ..... 280/37–43.1, 47.12, 280/47.2, 47.131, 47.17, 47.24, 47.26, 47.34, 47.371, 79.2, 655; 190/29, 34, 18 A, 39

(56) References Cited

U.S. PATENT DOCUMENTS

| | | | | |
|---|---|---|---|---|
| 5,519,919 | * | 5/1996 | Lee | 16/115 |
| 5,581,846 | * | 12/1996 | Wang | 16/115 |
| 5,746,440 | * | 5/1998 | Chen | 280/652 |
| 5,813,503 | * | 9/1998 | Chang | 190/18 A |
| 5,873,439 | * | 2/1999 | Liang | 190/18 A |
| 5,984,327 | * | 11/1999 | Hsieh | 280/47.24 |

* cited by examiner

*Primary Examiner*—Lanna Mai
(74) *Attorney, Agent, or Firm*—Dougherty & Troxell

(57) ABSTRACT

A two-stage expansion/collapse control mechanism is provided for use on a hand-trailable luggage case having an auxiliary wheel unit, which allows the auxiliary wheel unit to be expanded for use to support the luggage case when the extendable handle of the luggage case is being extended for use, and also allows the auxiliary wheel unit to be collapsed into the luggage case when the extendable handle is being pushed back into the luggage case.

6 Claims, 13 Drawing Sheets

TWO-STAGE EXPANSION/COLLAPSE CONTROL MECHANISM FOR USE ON A HAND-TRAILABLE LUGGAGE CASE

BACKGROUND OF THE INVENTION

1. Field of the Invention

This invention relates to a two-stage expansion/collapse control mechanism for use on a hand-trailable luggage case having an auxiliary wheel unit for the purpose of controlling the expansion/collapse of the auxiliary wheel unit.

2. Description of Related Art

A hand-trailable luggage case is widely used by travelers at airports to carry personal belongings, which is equipped with wheels and an extendable handle that allows the user to easily and effortlessly carry the luggage case by dragging it on its wheels along the ground. The extendable handle is normally retracted and locked in the luggage case and can be unlocked to be extended out for the user to drag the wheeled luggage case along the ground.

Conventional hand-trailable luggage cases are typically provided with only two wheels on the bottom. This type of hand-trailable luggage case, however, is inconvenient to use since the hand-trailable luggage case would not stand by itself on two wheels. Moreover, the inclination of the luggage case would cause part of the weight of the luggage case to be transferred to the user's dragging hand, thus requiring the user to use more effort to drag the hand-trailable luggage case. As a solution to this problem, newer types of hand-trailable luggage cases are provided with an auxiliary wheel unit consisting of two swiveling wheels in addition to the main wheel unit. The auxiliary wheel unit is normally collapsed to the luggage case, and can be expanded to serve an additional wheel unit that allows the hand-trailable luggage case to stand by itself on four wheels.

One such hand-trailable luggage case is shown in FIG. 7. As shown, the hand-trailable luggage case A includes an extendable handle B, a main wheel unit C, and an auxiliary wheel unit D. The auxiliary wheel unit D includes a hinge D1, an expandable frame D2, two wheels D3 (only one is shown), and a bendable arm D4. When not in use, the auxiliary wheel unit D is collapsed into the luggage case to facilitate convenient storage. To allow the hand-trailable luggage case to stand by itself on four wheels, the auxiliary wheel unit D can be expanded to allow the luggage case to stand by itself on four wheels. Moreover, the auxiliary wheel unit can take on part of the weight of the luggage case resulted from the inclination of the luggage case, thus allowing the user to drag the luggage case with less effort along the way.

One drawback to this hand-trailable luggage case, however, is that the expansion and collapsing of the auxiliary wheel unit needs to be done by hand. When doing this, the user's hand may be hurt by the expandable frame if care is not taken. There exists, therefore, a need for a new mechanism that allows the auxiliary wheel unit to be automatically expanded out of the luggage case when the handle is being extended for use, and thereafter be automatically collapsed into the luggage case when the handle is being retracted for storage.

SUMMARY OF THE INVENTION

It is therefore an objective of the present invention to provide a two-stage expansion/collapse control mechanism for use on a hand-trailable luggage case having an auxiliary wheel unit, which allows the auxiliary wheel unit to be expanded for use to support the luggage case when the extendable handle of the luggage case is being extended for use, and also allows the auxiliary wheel unit to be collapsed into the luggage case when the extendable handle is being pushed back into the luggage case.

It is another objective of the present invention to provide a two-stage expansion/collapse control mechanism for use on a hand-trailable luggage case having an auxiliary wheel unit, which allows the auxiliary wheel unit to be effortlessly expanded by the user.

In accordance with the foregoing and other objectives of the present invention, a two-stage expansion/collapse control mechanism for the auxiliary wheel unit on a hand-trailable luggage case is provided.

The two-stage expansion/collapse control mechanism for use on a hand-trailable luggage case, which comprises: an extendable frame provided on said luggage case, which includes an inner tube and an outer tube; a handle provided on the extendable frame; a first locking device provided in the extendable frame; a second locking device provided at the bottom of the extendable frame; a first rigid pull-push device operatively coupled to the first locking device; and a second rigid pull-push device operatively coupled to the second locking device; wherein when the handle is pressed down for first-stage control, the first rigid pull-push device is being lifted to pull the first locking device, thereby disengaging the inner tube from the outer tube, allowing the inner tube to be extended out to a predetermined position; and when the handle is further pressed for second-stage control, the first locking device is further unlocked from the position and is lifted to pull the second rigid pull-push device, allowing the second locking device to unlocked.

BRIEF DESCRIPTION OF THE DRAWING

The invention can be more fully understood by reading the following detailed description of the preferred embodiments, with reference made to the accompanying drawings, wherein.

DETAILED DESCRIPTION OF THE PREFERRED EMBODIMENTS

Figure 1:
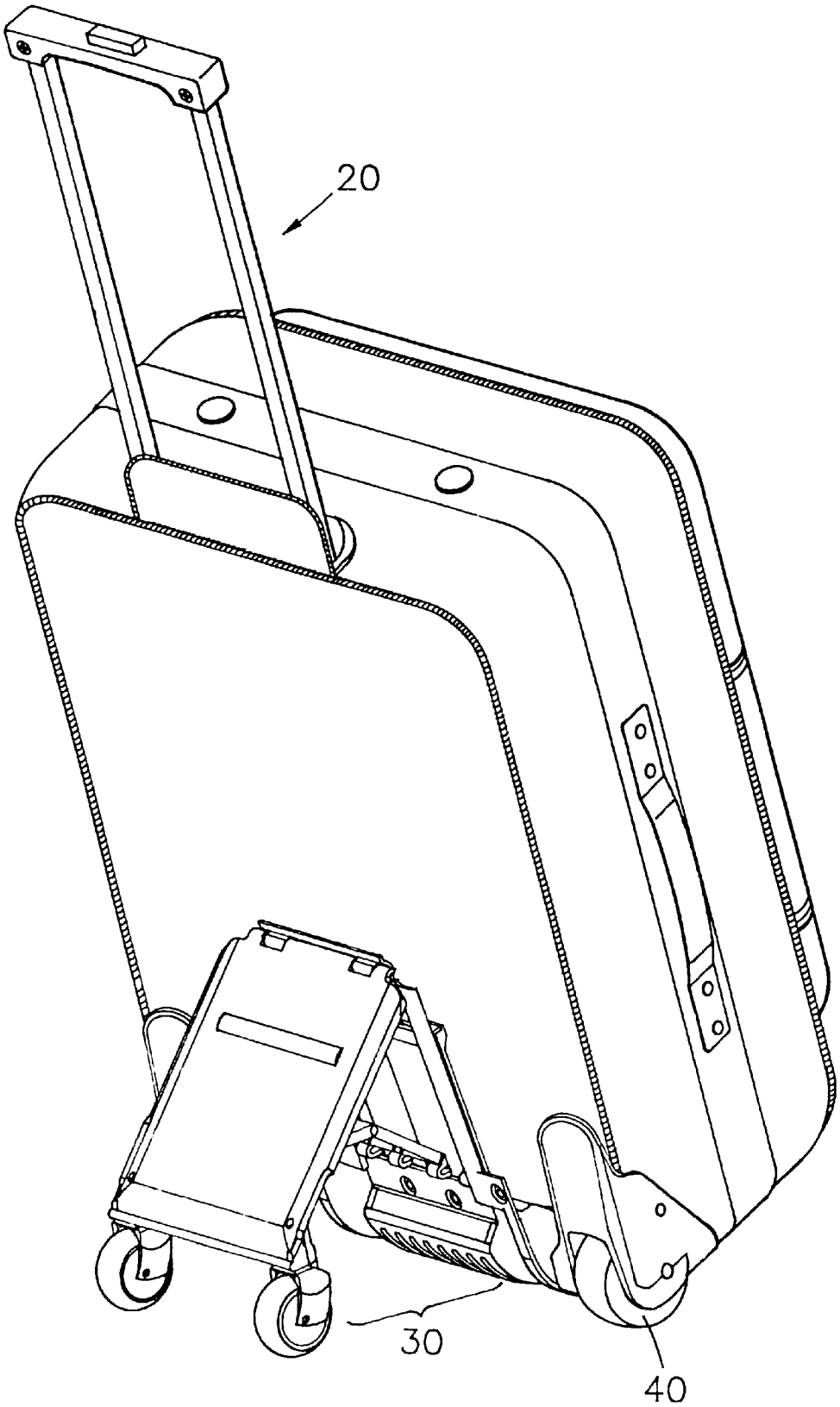
FIG. 1 is a perspective view of a hand-trailable luggage case utilizing the two-stage expansion/collapse control mechanism of the invention to control the expansion/collapse of the auxiliary wheel unit on the hand-trailable luggage case.

FIG. 1 is a perspective view of a hand-trailable luggage case utilizing the two-stage expansion/collapse control mechanism of the invention. As shown, the hand-trailable luggage case includes an auxiliary wheel unit 30 and a main wheel unit 40. The two-stage expansion/collapse control mechanism of the invention is designated by the reference numeral 20 and is used to control the expansion/collapse of the auxiliary wheel unit 30 in a two-stage manner in which the first-stage control is used to control the extending of an inner tube 22 linked to the handle, while the second-stage control is used to control the expansion/collapse of the auxiliary wheel unit 30.

Figure 2A:
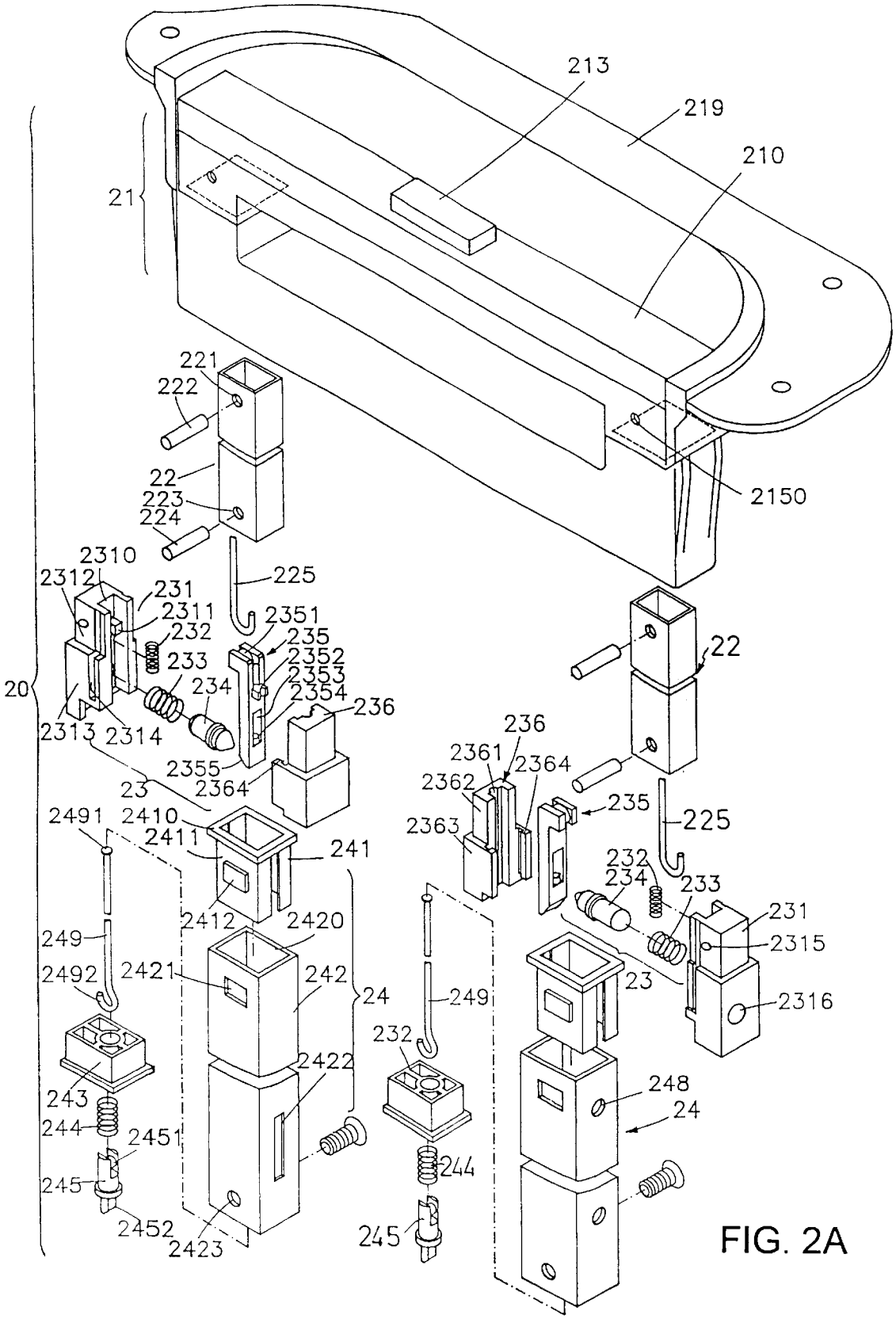
FIG. 2A is an exploded perspective view of the two-stage expansion/collapse control mechanism of the invention.
Figure 2B:
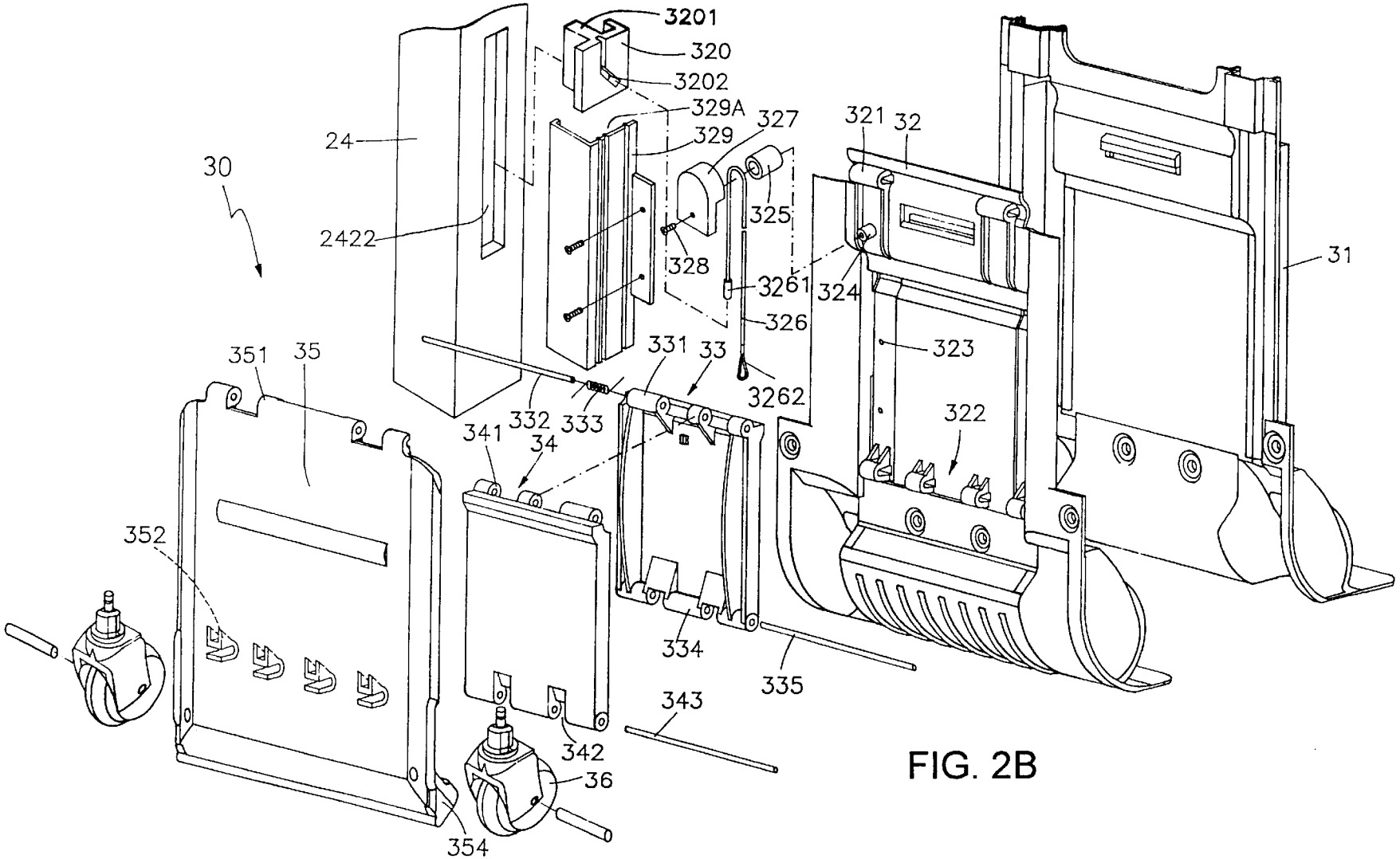
FIG. 2B is an exploded perspective view of the auxiliary wheel unit on the hand-trailable luggage case which is actuated by the two-stage expansion/collapse control mechanism of the invention.
Figure 2C:
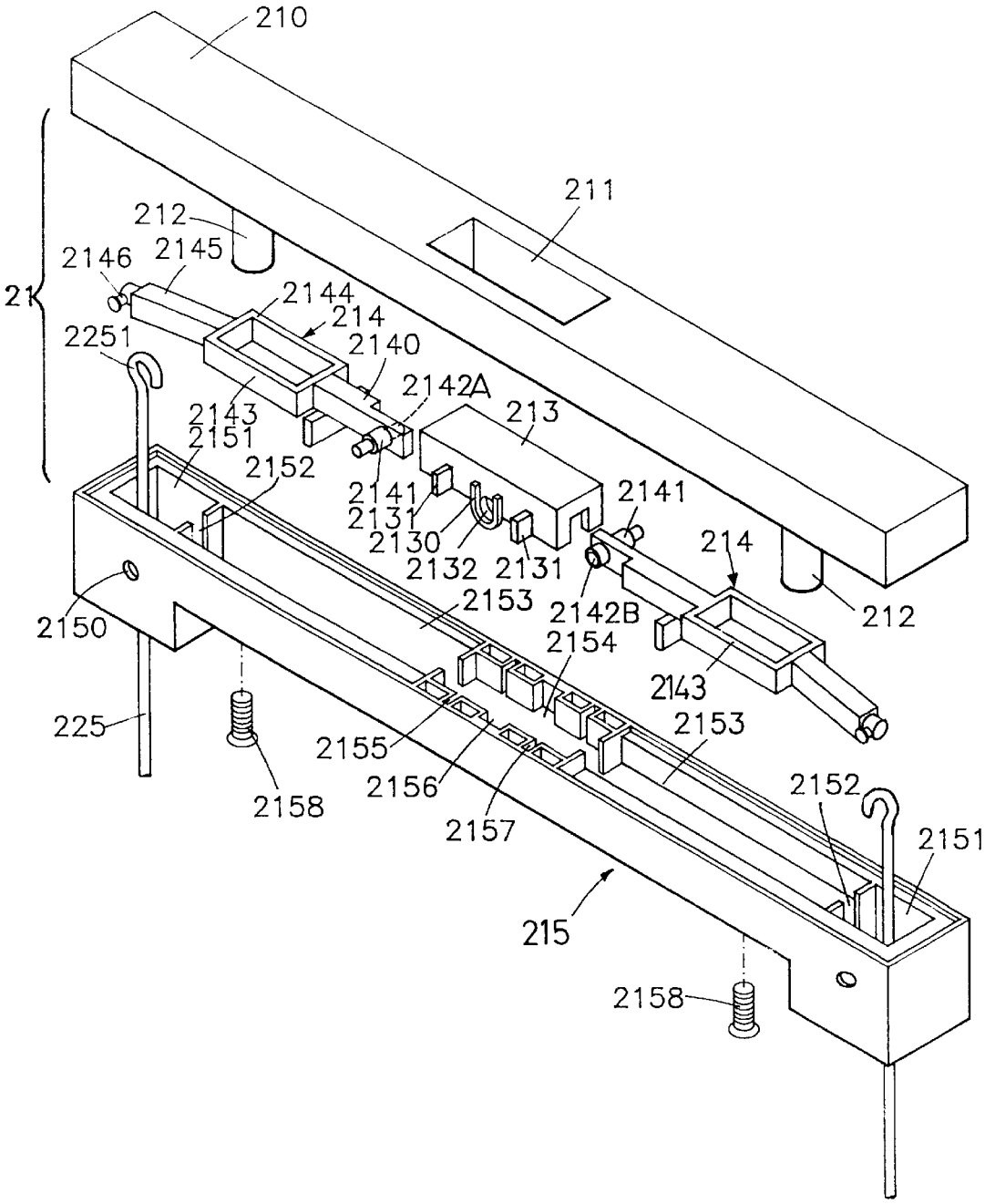
FIG. 2C is an exploded perspective view of the handle part of the two-stage expansion/collapse control mechanism of the invention.

Referring to FIGS. 2A–2C and 3A–3D, the expansion/collapse control mechanism 20 includes an extendable handle 21, an inner tube 22, an outer tube 24, a first locking device 23 provided at the bottom end of the inner tube 22, a first rigid pull-push device 225 provided in the inner tube 22, a second locking device 245 provided at the bottom end of the outer tube 24, and a second rigid pull-push device 249 provided in the outer tube 24. As shown in FIG. 2C, the expansion/collapse control mechanism 20 includes a top cover 210, a button 213, a pair of linkage bars 214, and a bottom cover 215. The top cover 210 is formed with a rectangular opening 211 allowing the button 213 to expose to the outside. Both ends of the top cover 210 are each provided with a peg 212 which has a threaded bore allowing the top cover 210 to be fastened to the bottom cover 215 by means of screws 2158. Both ends of the bottom cover 215 are each provided with a hollowed tube 2151. Moreover, the bottom cover 215 is provided with a plurality of positioning slots 2154, 2155, 2156, 2157 in the middle and a pair of positioning slots 2152 between the middle and the hollowed tubes 2151. The button 213 is provided with a pair of tongues 2131 near both ends and a substantially U-shaped protrusion 2130 in the middle, which are coupled respectively to the positioning slots 2154, 2155, 2156, 2157 in the bottom cover 215. The linkage bars 214 are each provided with a pivotal section 2140. Moreover, one of the linkage bars 214 is provided with a male coupler 2142A on the pivotal axis 2141 thereof, and the other is provided with a female coupler 2142B. The male coupler 2142A and the female coupler 2142B can be coupled together inside the button 213. The pivotal axis 2141 is protruded through the hole 2132 to the outside of the button 213. Further, the linkage bars 214 are each formed with a hollowed rectangular member 2143 in the middle and a supporting arm 2145 linked to the hollowed rectangular member 2143. A locking member 2146 is formed at the free end of the supporting arm 2145. The pivotal section 2140 of the linkage bars 214 is upwardly oriented; the hollowed rectangular member 2143 is horizontally oriented; and the supporting arm 2145 is downwardly oriented.

The expansion/collapse control mechanism further includes a pair of rigid pull-push devices 225, 249 in association with the first locking device 23 on the inner tube 22 and the second locking device 245 on the outer tube 24, as illustrated in FIG. 2A and FIGS. 3A–3D. As shown in FIG. 2A, the inner tube 22 is fastened to the handle 21 by means of bolt 222 and hole 221 and to the first half casing 231 of the first locking device 23 by means of bolt 224 and holes 223 and 2315. The outer tube 24 is formed with holes 2421 near the top end, which can stop the protruded portion 2412 of the upper sleeve 241. Moreover, a bottom sleeve 243 is provided at the bottom of the outer tube 24; and an elongated guide slot 2422 is formed in the outer tube 24.

As shown in FIG. 2A, the first locking device 23 includes a first half casing 231, a second half casing 236, a longitudinal restoration spring 232, a horizontal restoration spring 233, a horizontal locking bolt 234, and a longitudinal locking member 235. The upper part of each of the first half casing 231 and the second half casing 236 is formed into a two-unit body including a small upper part and a large bottom part. The bottom part is substantially equal in diameter as the inner tube 22, allowing the casing to be insertable into the bottom end of the inner tube 22. The first half casing 231 is formed with a pair of longitudinal guide slot 2314 respectively on the two sides thereof, which allow the guide piece 2364 on the second half casing 236 to fit therein so as to couple the second half casing 236 to the first half casing 231, with a gap therebetween to accommodate the longitudinal locking member 235 therein. The first half casing 231 is formed with a slot 2310 in which a block 2311 is provided. Moreover, a longitudinal slot 2353 is provided in association with the longitudinal locking member 235, which allows the longitudinal restoration spring 232 to be mounted on the post 2354 at the bottom of the inside of the longitudinal slot 2353. Further, the first half casing 231 is formed with a horizontal through hole 2316 in the bottom part thereof. The horizontal through hole 2316 allows the horizontal locking bolt 234, which is coupled to the horizontal restoration spring 233, to move horizontally therein. The longitudinal locking member 235 is a substantially L-shaped member having a short horizontal arm provided with a peg 2351 which can be hooked to the bottom hooked portion of the first rigid pull-push device 225, and a long longitudinal arm provided with a yoke 2352 which is operatively coupled to the top protruded portion 2491 of the second rigid pull-push device 249. The second locking device 245 includes a locking bolt 2450 with a peg 2451 on the top portion and a restoration spring 244 sleeving on the locking bolt 2450 and nesting in the central hole of the bottom sleeve 243 so as to have the lower end of the locking bolt 2450 to project out of the bottom sleeve 243 and to have it to be maintained in locked state. It can be seen from FIGS. 3A–3C that the first rigid pull-push device 225 has its upper end 2251 hooked to the locking member 2146 on the linkage bars 214 and has its bottom end hooked to the peg 2351 on the longitudinal locking member 235; whereas the second rigid pull-push device 249 has its upper end movable between the first half casing 231 and the second half casing 236 with the protruded portion 2491 abutting on the yoke 2352 on the longitudinal locking member 235, and has its bottom hook portion 2492 hooked to the peg 2451 of the locking bolt 2450 sleeved with the restoration spring 244 on the bottom sleeve 243. Further, the second locking device 245, in this preferred embodiment, is used to control the expansion/collapse of the auxiliary wheel unit 30. The cooperative relation between the auxiliary wheel unit 30 and the second rigid pull-push device 249 will be depicted in the following.

As shown in FIG. 2B, the auxiliary wheel unit 30 includes a base plate 31, a securing plate 32, a movable plate 35, a first supporting plate 33, and a second supporting plate 34. The first and second supporting plates 33, 34 are provided between the securing plate 32 and the movable plate 35 and are used to support the expansion of the movable plate 35. The securing plate 32 is affixed to the base plate 31. The movable plate 35 is turnably fastened to the securing plate 32 by means of hinges 321, 351 respectively on the securing plate 32 and the movable plate 35. The first and second supporting plates 33, 34 are respectively provided with hinges 331, 341 on the top thereof which are coupled to each other by means of a spring 333 and a peg 332, and are respectively provided with hinges 334, 342 on the bottom thereof which are respectively coupled to the hinge 322 on the securing plate 32 and to the hinge 352 on the movable plate 35. The movable plate 35 is provided with a pair of auxiliary wheels 36 and can be expanded by means of the first and second supporting plates 33, 34 and the spring 333.

Figure 4:
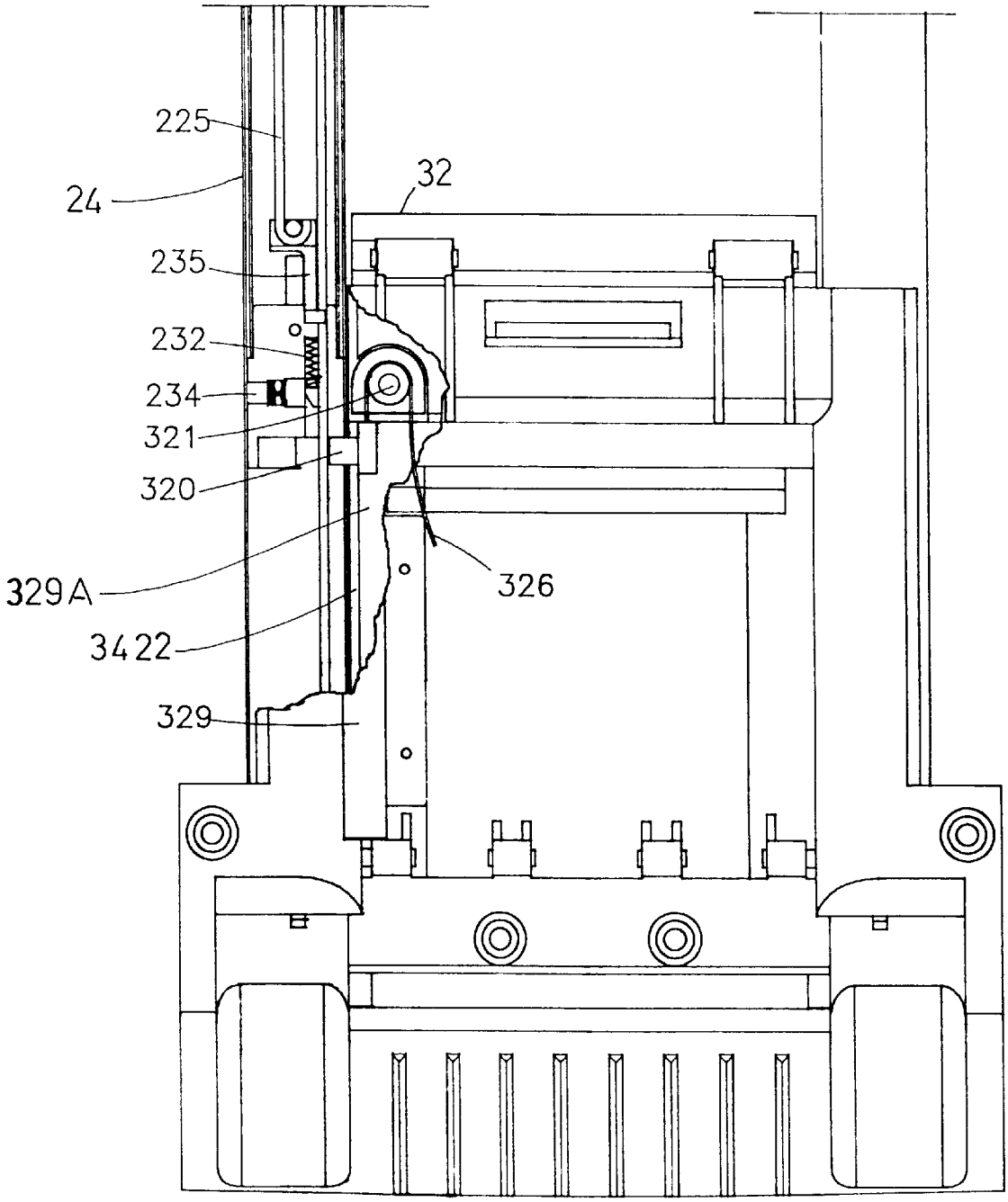
FIG. 4 is a plan view of the two-stage expansion/collapse control mechanism of the invention when coupled to the auxiliary wheel unit.
Figure 6A:
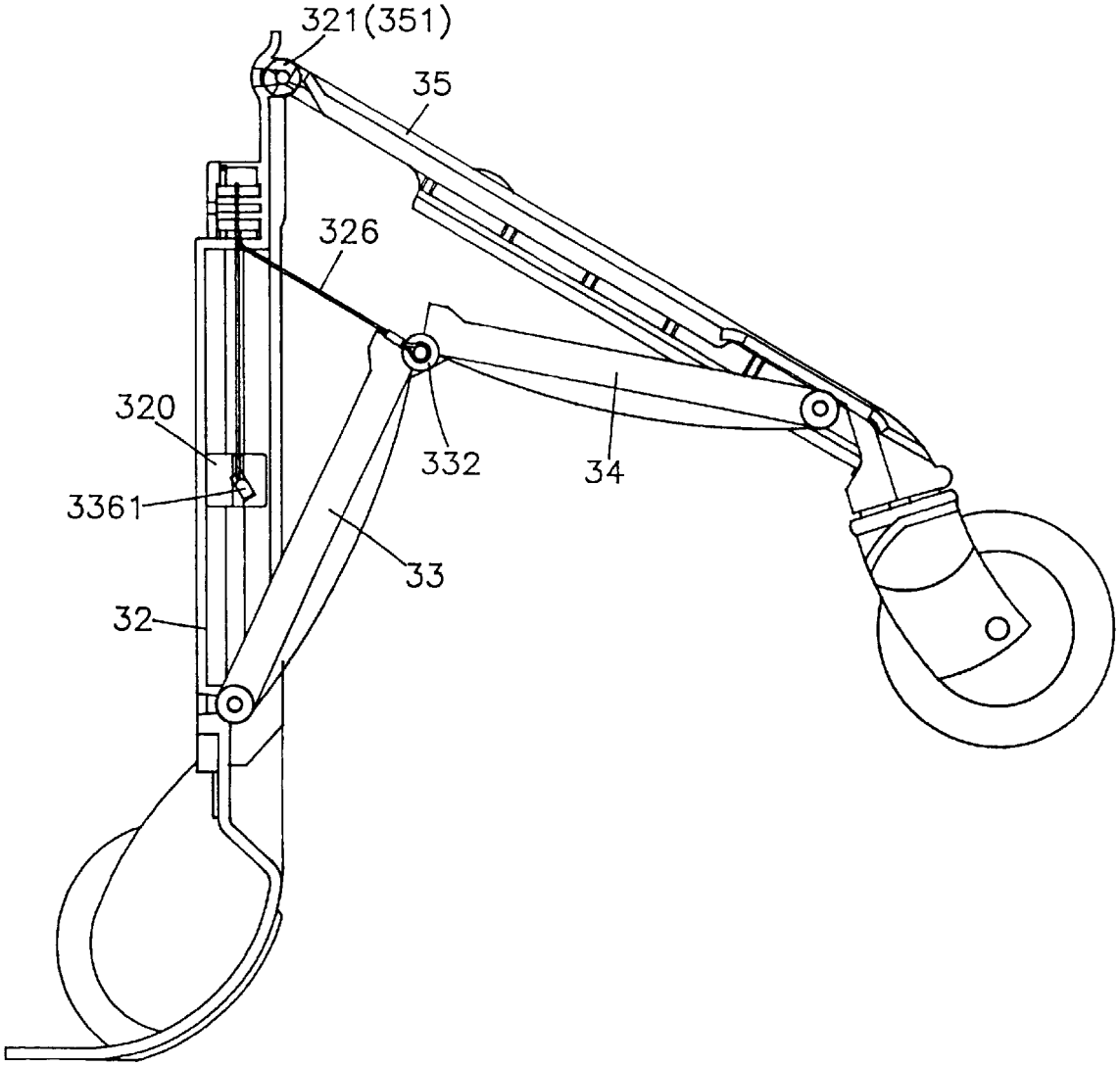
FIG. 6A is a schematic diagram showing the auxiliary wheel unit when half expanded.
Figure 6B:
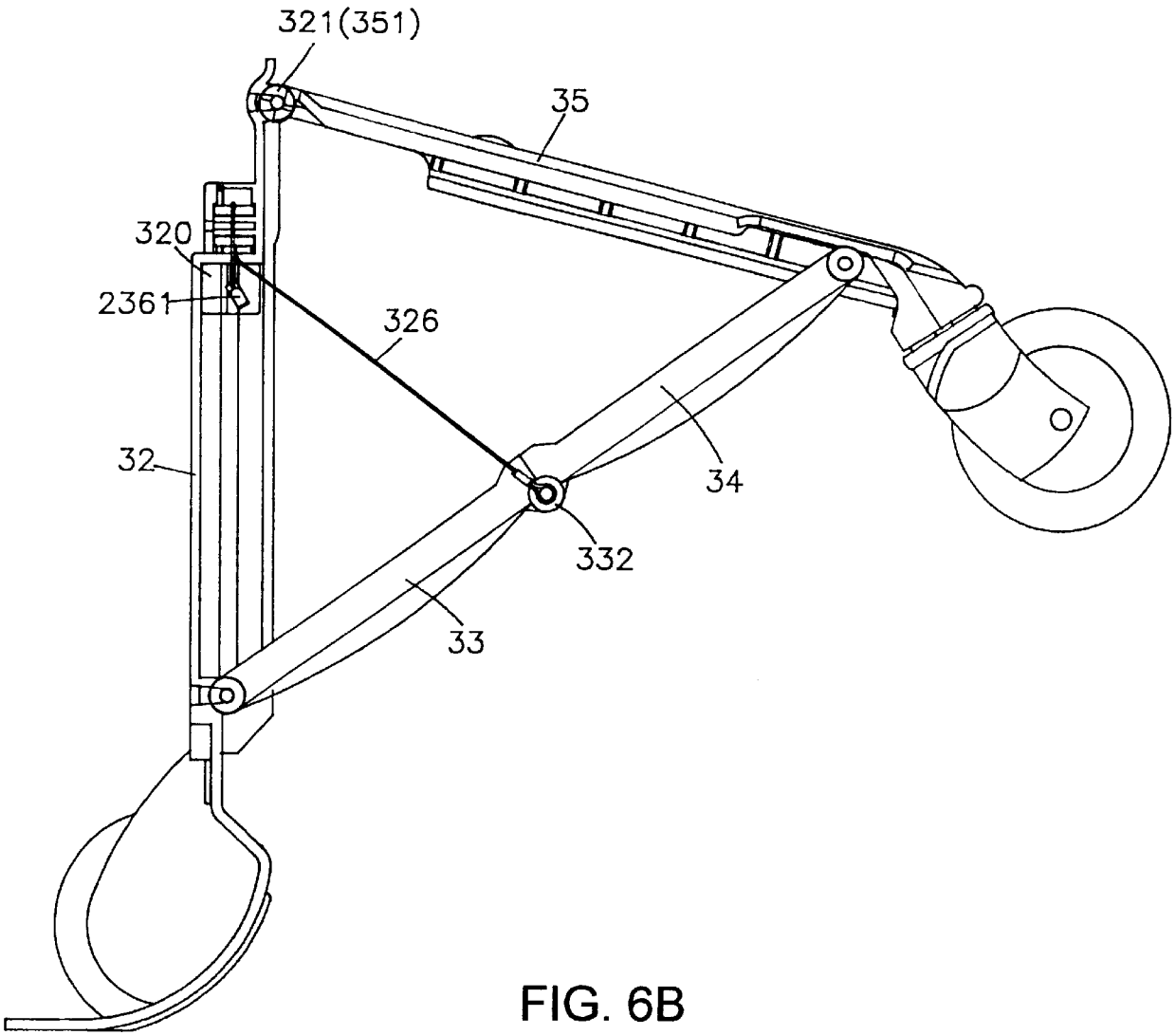
FIG. 6B is a schematic diagram showing the auxiliary wheel unit when fully expanded.
Figure 7:
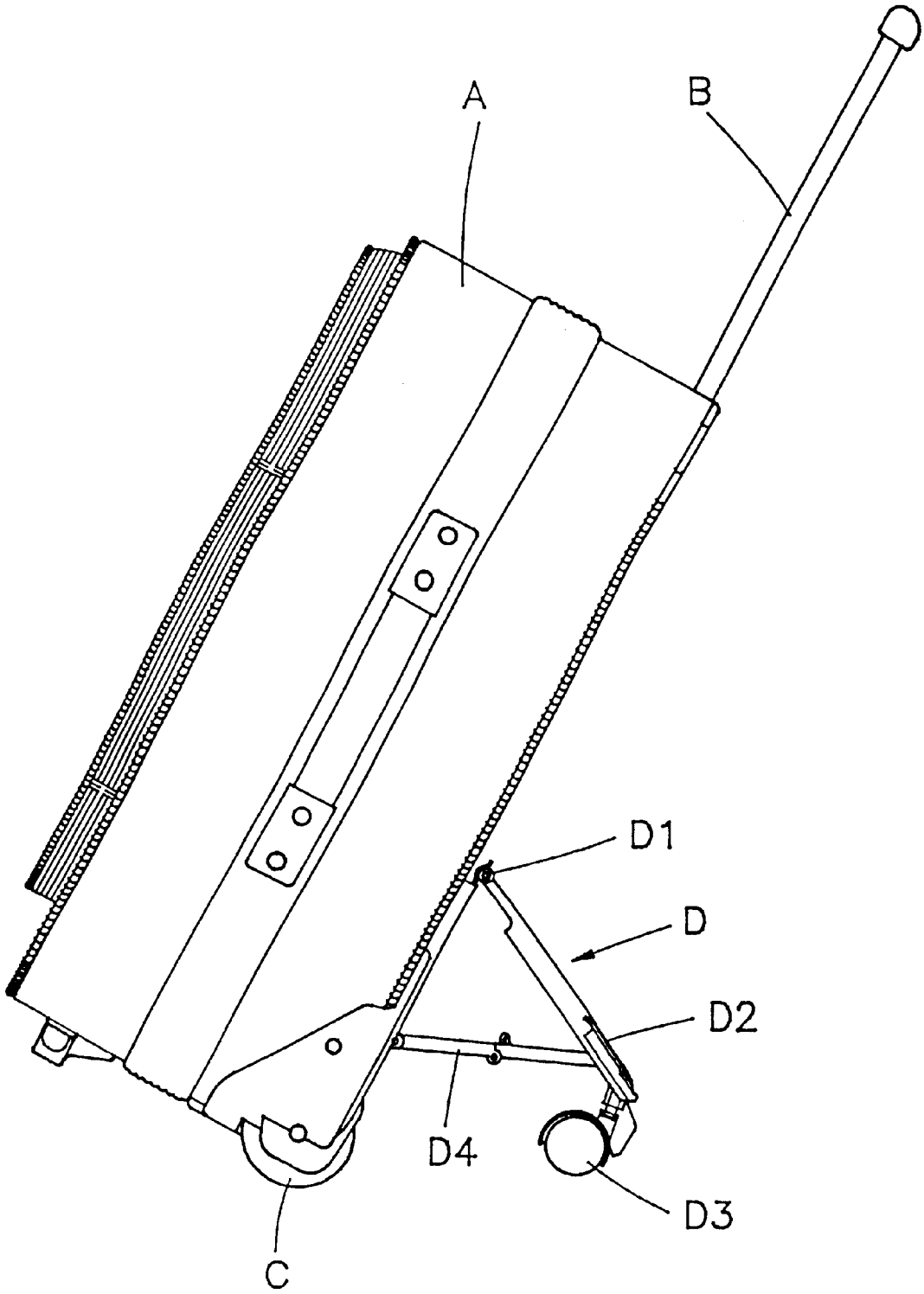
FIG. 7 (PRIOR ART)
FIG. 7 is a schematic sectional view showing a conventional hand-trailable luggage case which includes an auxiliary wheel unit in addition to a main wheel unit to support the luggage case on four wheels.

As shown in FIG. 2B and FIG. 4, a substantially L-shaped member 329 is provided on the securing plate 32. A void portion 329A is formed between the outer tube 24 and the securing plate 32, which serves as a channel allowing the T-shaped block 320 to be movable therewithin. The T-shaped block 320 has a protruded portion 3201 penetrating into the guide slot 2422 in the outer tube 24. Moreover, the T-shaped block 320 is formed with a slot 3202 which can be engaged with the copper-formed block 3261 on a steel cord 326. The steel cord 326 is attached to the pulley 325 on the post 324, with one end 3262 being connected to the axis of the first and second supporting plates 33, 34. The pulley 325 is covered by a cover 327. As shown in FIG. 2B and FIG. 4, when the T-shaped block 320 is being urged by the inner tube 22 to move downwards along the guide slot 2422, the steel cord 326 will be pulled, thereby collapsing the first and second supporting plates 33, 34, as illustrated in FIG. 6A. On the other hand, when the inner tube 22 is moving upwards, the steel cord 326 will be stretched, thereby causing the first and second supporting plates 33, 34 to be expanded by the spring 333, further causing the auxiliary wheel unit 30 to be expanded for use to support the luggage case, as illustrated in FIG. 6B.

Figure 3A:
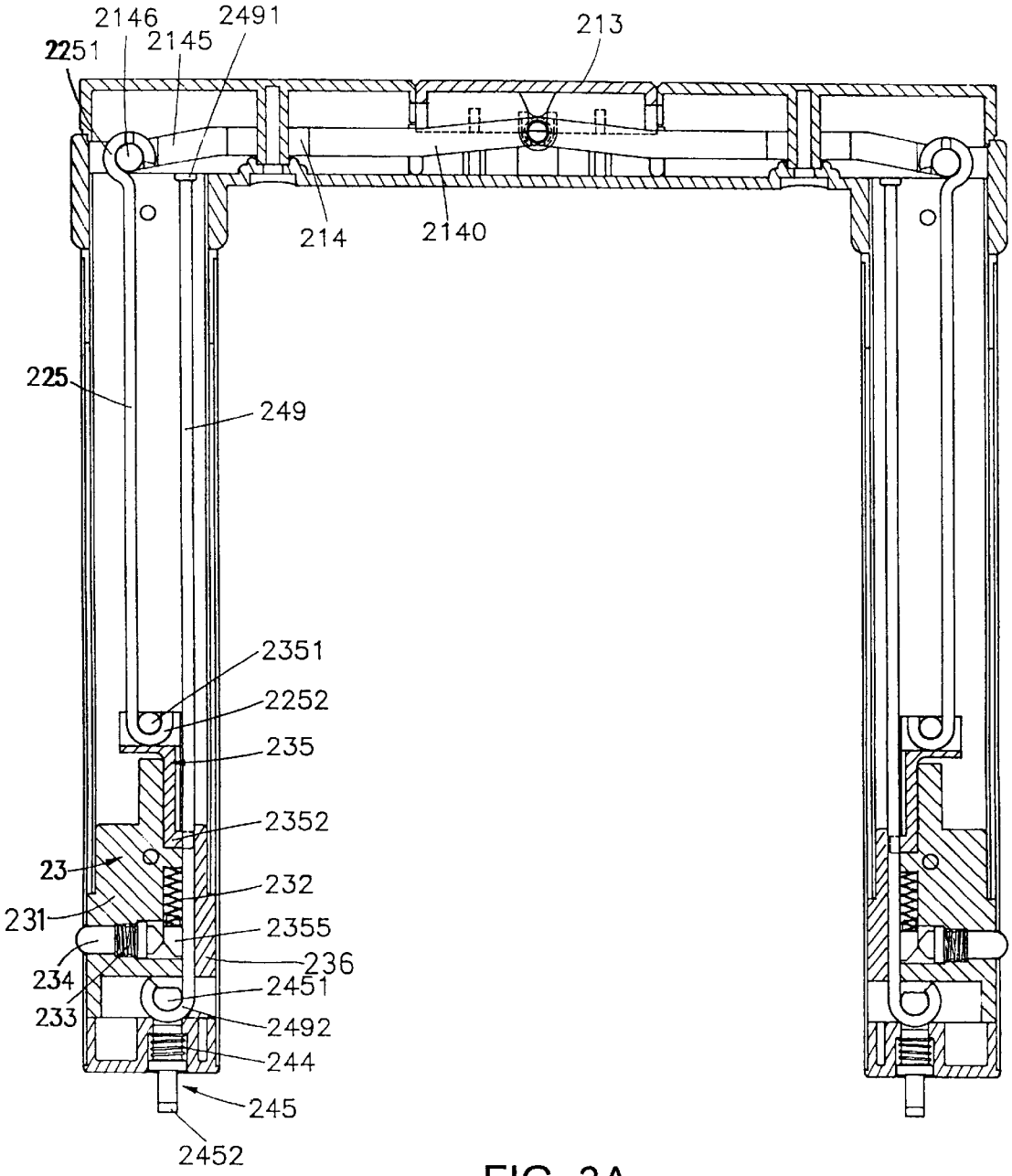
FIG. 3A is a sectional view of the two-stage expansion/collapse control mechanism of the invention when assembled.
Figure 3B:
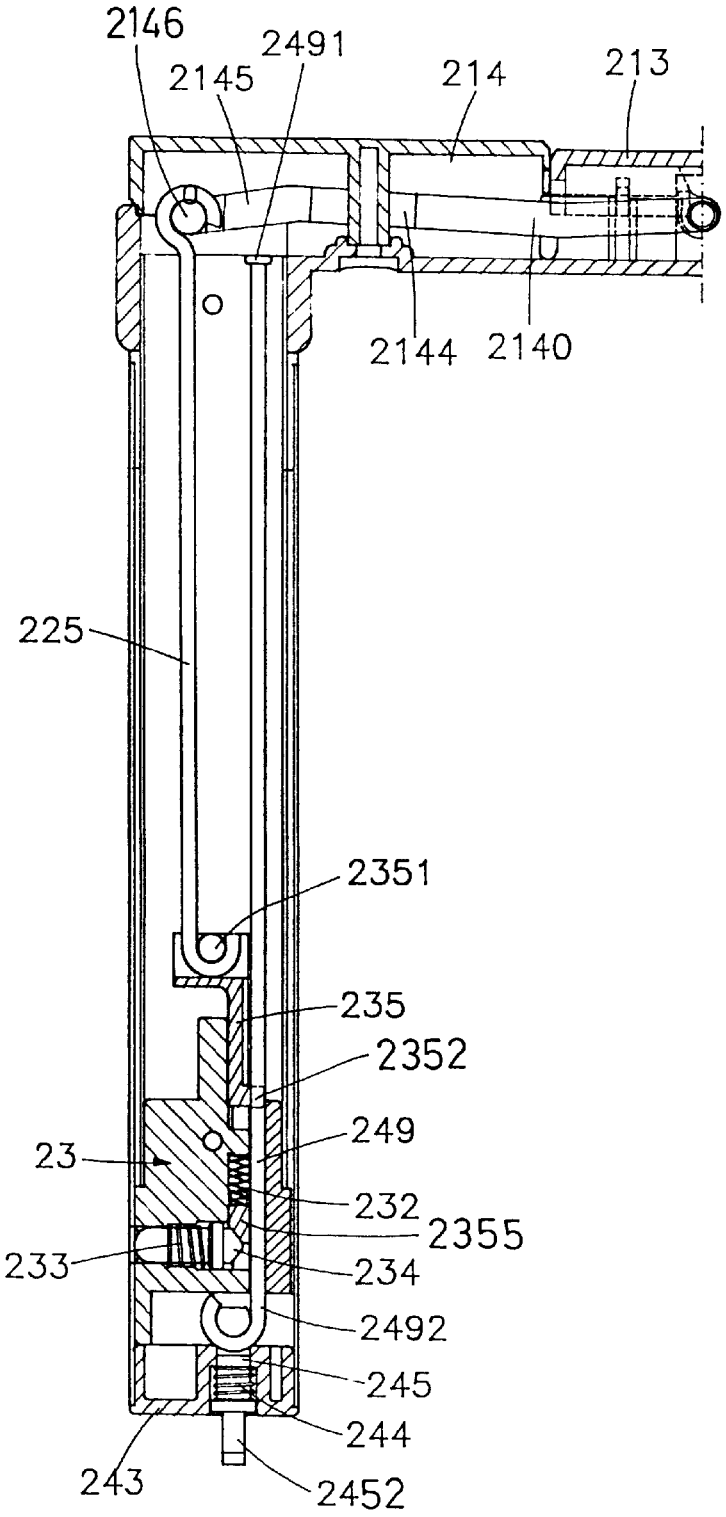
FIG. 3B is a sectional view of the two-stage expansion/collapse control mechanism of the invention when operating at the first-stage control.
Figure 3C:
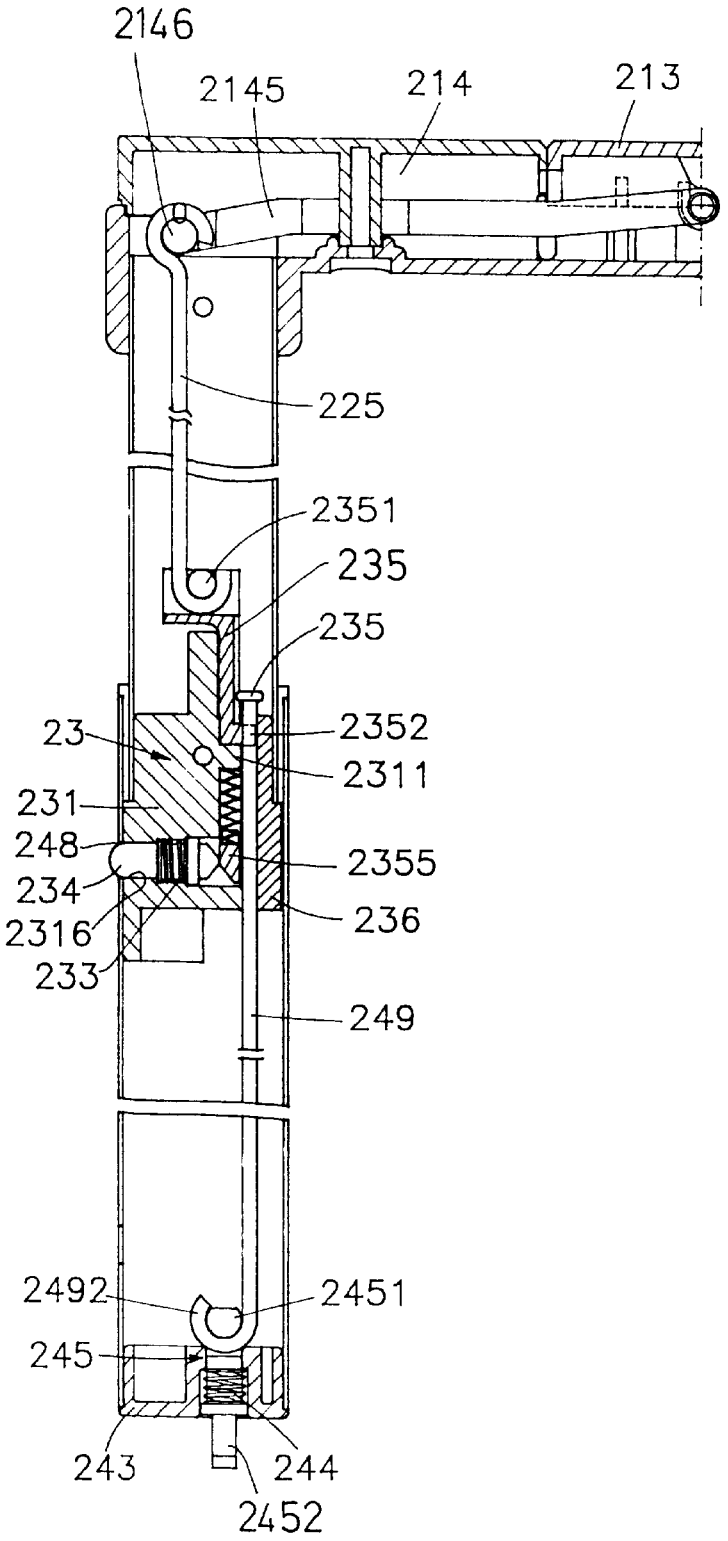
FIG. 3C is a sectional view of the two-stage expansion/collapse control mechanism of the invention when the inner tube is extended out.
Figure 3D:
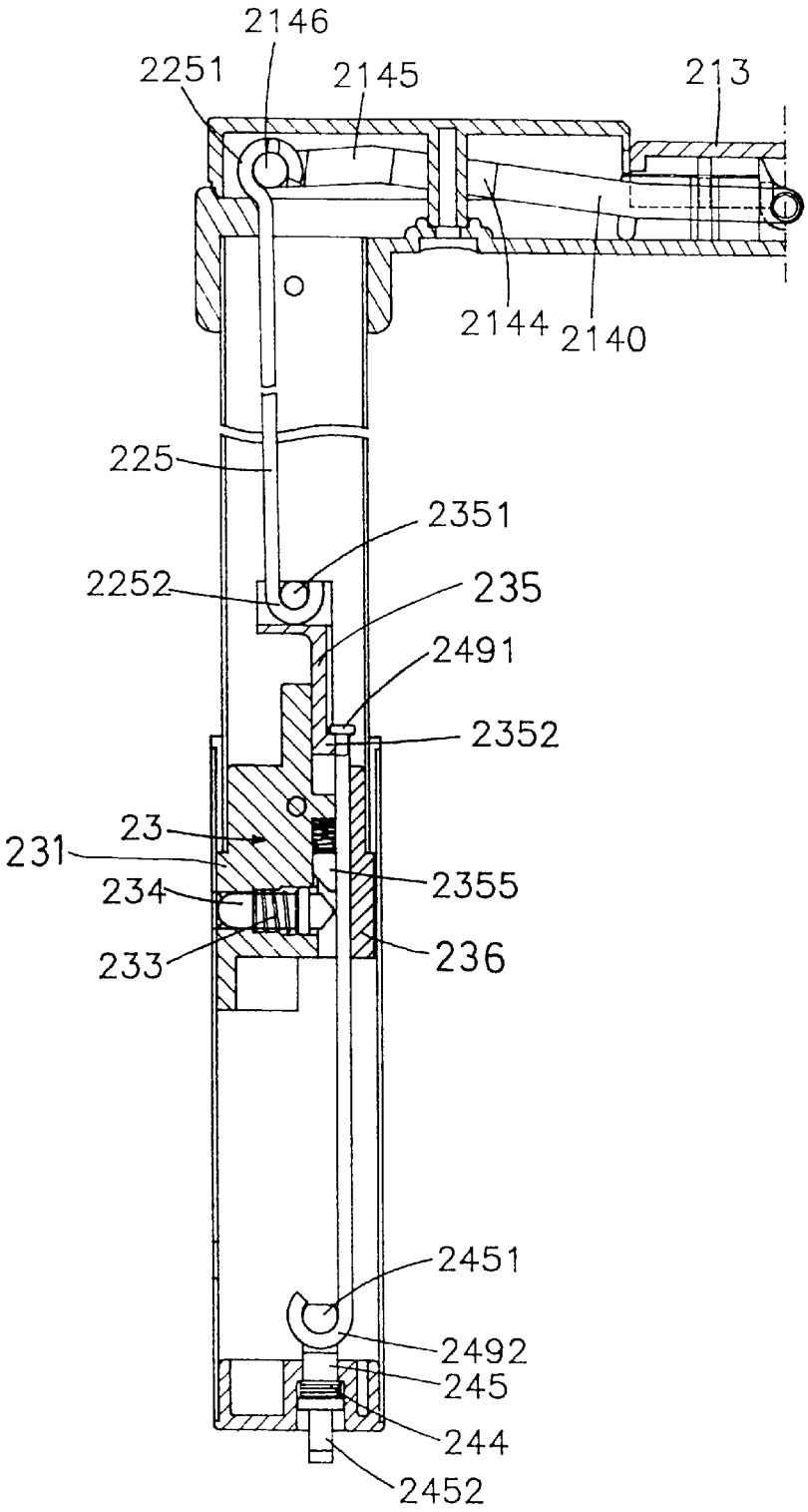
FIG. 3D is a sectional view of the two-stage expansion/collapse control mechanism of the invention when operating at the second-stage control.
Figure 5:
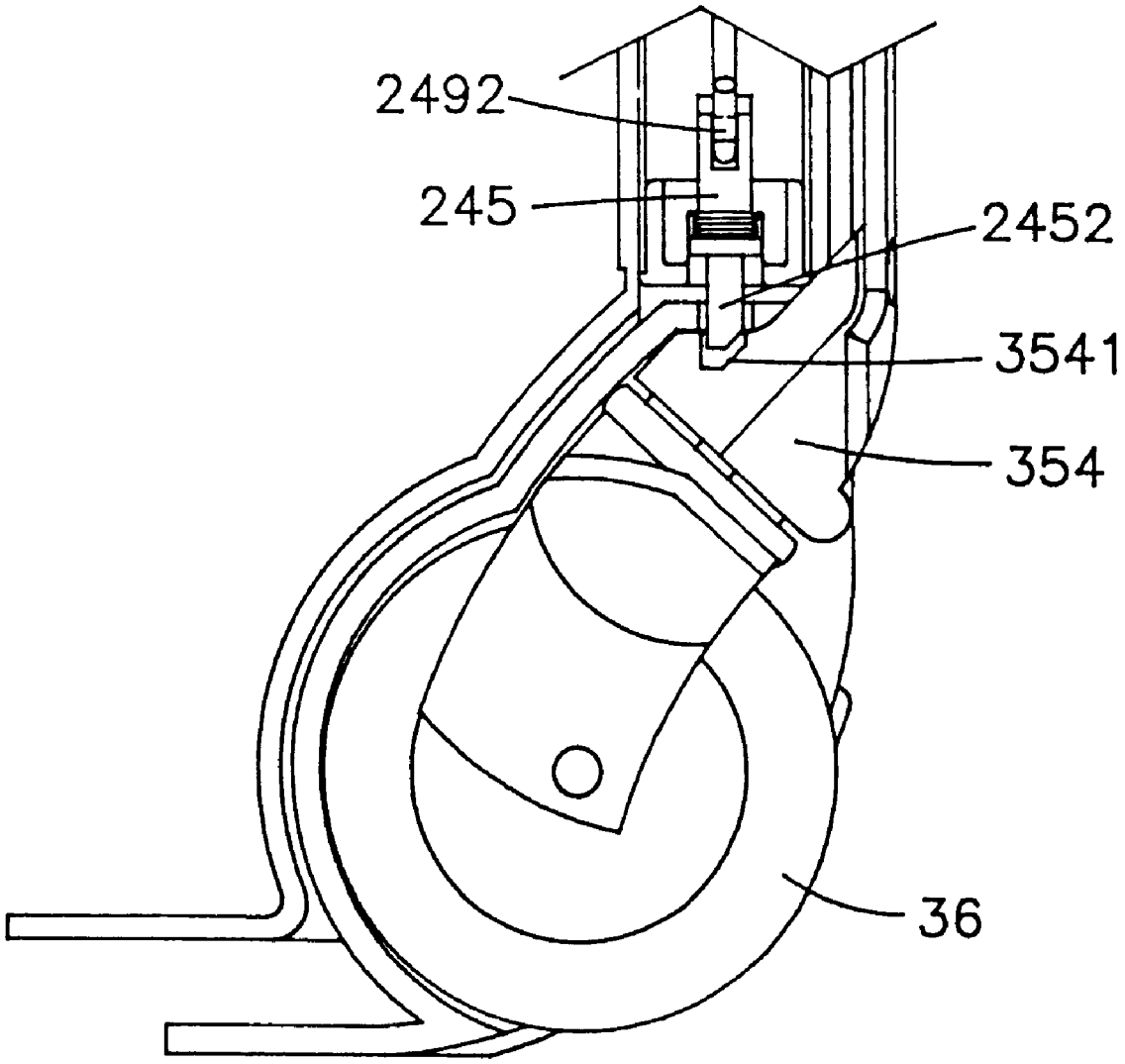
FIG. 5 is a plan view of one wheel in the auxiliary wheel unit which is being locked by the two-stage expansion/collapse control mechanism of the invention.

In operation, when the users presses the button 213 on the handle 21 (for first-stage control), since the pivotal section 2140 of the linkage bars 214 coupled to the button 213 is relatively elevated in horizontal position (as illustrated in FIG. 3A), the supporting arm 2145 of the linkage bar 214 can be lifted upwards (as illustrated in FIG. 3B). At this time, since the first rigid pull-push device 225 pulls the longitudinal locking member 235 and thereby lifts the wedged bottom portion 2355 upwards, subsequently causing the horizontal locking bolt 234 to retract due to the elastic force from the horizontal restoration spring 233. As a result, the bottom of the inner tube 22 is disengaged from the outer tube 24, causing the inner tube 22 to lift upwards and the horizontal locking bolt 234 to be locked to the hole 248 at the top end of the outer tube 24 as illustrated in FIG. 3C. This allows the user to drag the luggage case. When the user wishes to support the luggage case with four wheels when dragging the luggage case along the way, the user can simply press the button 213 again (for second-stage control). When this is being done, it causes the supporting arm 2145 of the linkage bars 214 to be further lifted upwards, as illustrated in FIG. 3D. At this time, the first rigid pull-push device 225 further pulls the longitudinal locking member 235 upwards, thereby causing the yoke 2352 to pull the protruded portion 2491 of the second rigid pull-push device 249 upwards. As a result, the second locking device 245 hooked to the hook portion 2492 is unhooked from the hole 3541 in the movable plate 35 on the auxiliary wheel unit 30, as illustrated in FIG. 5. The movable plate 35 on the auxiliary wheel unit 30 is therefore expanded due to the elastic force from the spring 333, as illustrated in FIG. 6A and FIG. 6B.

When the user wishes to collapse the auxiliary wheel unit 30, the user can simply press the button 213 to cause the bottom of the inner tube 22 to be disengaged from the outer tube 24, allowing the inner tube 22 to move downwards and retract into the outer tube 24. As shown in FIG. 4, when the bottom of the inner tube 22 touches the T-shaped block 320, it causes the T-shaped block 320 to slide downwards along the void portion 329A between the guide slot 2422 and the L-shaped member 329 in the outer tube 24; and meanwhile, the steel cord 326 is also dragged to move downwards, causing the first and second supporting plates 33, 34 on the auxiliary wheel unit 30 to be withdrawn and then folded up, as illustrated in FIG. 6A. When the T-shaped block 320 reaches the bottom of the guide slot 2422, the auxiliary wheel unit 30 is completely collapsed into the luggage case. Moreover, the second locking device 245 on the second rigid pull-push device 249 is locked into the locking hole 3541 in the movable plate 35, as illustrated in FIG. 5. The auxiliary wheel unit 30 is then locked in position in the collapsed state.

In conclusion, the expansion/collapse control mechanism of the invention allows the auxiliary wheel unit to be expanded for use to support the luggage case when the extendable handle of the luggage case is being extended for use by the user, and also allows the auxiliary wheel unit to be collapsed into the luggage case when the extendable handle is being pushed back into the luggage case.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A two-stage expansion/collapse control mechanism for use on a hand-trailable luggage case having a main wheel unit and an auxiliary wheel unit, the control mechanism comprising:

an extendable frame provided on said luggage case, which includes an inner tube and an outer tube;

a handle provided on the extendable frame, the handle having a button;

a first locking device provided in the extendable frame;

a second locking device provided at a bottom of the extendable frame;

a first rigid pull-push device operatively coupled to the first locking device;

a second rigid pull-push device operatively coupled to the second locking device; and, a pulling device coupled to a bottom of the inner tube for use in conjunction with the second locking device coupled to the second rigid pull-push device to control expansion/collapse of the auxiliary wheel unit;

wherein when the button is pressed down for first-stage control, the first rigid pull-push device is lifted to pull the first locking device, allowing the inner tube to be extended out of the outer tube to a predetermined position; and when the button is pressed for second-stage control when the inner tube is in the predetermined position, the first locking device is further unlocked and is lifted to pull the second rigid pull-push device, allowing the second locking device to be unlocked.

2. The two-stage expansion/collapse control mechanism of claim 1, wherein the handle is provided with a casing in which the button is provided, the button being linked to a pair of linkage bars, each linkage bar being linked to the first rigid pull-push device; and wherein when the button is pressed down, the linkage bars lift the first rigid pull-push device, thereby unlocking the first locking device.

3. The two-stage expansion/collapse control mechanism of claim 2, wherein the linkage bars each have an inner section, a middle section, and an outer section, with the inner section being highest in horizontal position and the outer section being lowest in horizontal position, and with the middle section serving as a pivotal point, allowing the outer section to be lifted when the inner section is being pressed down to cause the first locking device to be unlocked.

4. The two-stage expansion/collapse mechanism of claim 1, wherein the pulling device includes: a T-shaped block which is movable in a guide slot formed in the bottom of the outer tube; a steel cord having a first end linked to the T-shaped block and a second end linked to the auxiliary wheel unit; a pulley for guiding the steel cord; a substantially L-shaped member mounted between a securing plate of the auxiliary wheel unit and the outer tube to define a channel between the L-shaped member and the outer tube to allow the T-shaped block to be movable therethrough, allowing the steel cord to be pulled by the T-shaped block to control the expansion/collapse of the auxiliary wheel unit.

5. The two-stage expansion/collapse control mechanism of claim 1, wherein the first locking device includes a first half casing and a second half casing having a top end insertable into a bottom end of the inner tube; a longitudinal locking device which is movable between the first half casing and the second half casing; a longitudinal restoration spring provided in the longitudinal locking device; a horizontal locking device provided at a bottom end of the first half casing and the second half casing; and a horizontal restoration spring acting on the horizontal locking device, with the horizontal locking device being locked or unlocked by changing a longitudinal position of the longitudinal locking device.

6. The two-stage expansion/collapse control mechanism of claim 1, wherein the second locking device includes a locking bolt having one end hooked to the second rigid pull-push device; and a restoration spring acting on the locking bolt so as to bias the lock bolt to a locked state.

* * * * *